US010971820B2

(12) United States Patent
Lindmark

(10) Patent No.: US 10,971,820 B2
(45) Date of Patent: Apr. 6, 2021

(54) ARRANGEMENT COMPRISING ANTENNA ELEMENTS

(71) Applicant: FILTRONIC WIRELESS AB, Taby (SE)

(72) Inventor: Bjorn Lindmark, Sollentuna (SE)

(73) Assignee: FILTRONIC WIRELESS AB, Taby (SE)

( * ) Notice: Subject to any disclaimer, the term of this patent is extended or adjusted under 35 U.S.C. 154(b) by 1 day.

(21) Appl. No.: 16/342,414

(22) PCT Filed: Oct. 25, 2017

(86) PCT No.: PCT/EP2017/077315
§ 371 (c)(1),
(2) Date: Apr. 16, 2019

(87) PCT Pub. No.: WO2018/077952
PCT Pub. Date: May 3, 2018

(65) Prior Publication Data

US 2019/0252777 A1 Aug. 15, 2019

(30) Foreign Application Priority Data

Oct. 25, 2016 (SE) ..... 1651391-3

(51) Int. Cl.
*H01Q 5/378* (2015.01)
*H01Q 21/24* (2006.01)
(Continued)

(52) U.S. Cl.
CPC ..... *H01Q 5/378* (2015.01); *H01Q 1/241* (2013.01); *H01Q 9/0414* (2013.01);
(Continued)

(58) Field of Classification Search
None
See application file for complete search history.

(56) References Cited

U.S. PATENT DOCUMENTS 5,717,410 A * 2/1998 Ohmine ..... H01Q 13/10 343/771
7,064,714 B2 6/2006 Lafleur
(Continued)

FOREIGN PATENT DOCUMENTS

| | | | |
|---|---|---|---|
| CN | 2924819 | Y | 7/2007 |
| CN | 102918712 | A | 2/2013 |
| WO | 2015/124573 | A1 | 8/2015 |

OTHER PUBLICATIONS

Office Action issued in Chinese Patent Application No. 201780066001.8 dated Mar. 19, 2020.
(Continued)

*Primary Examiner* — Jany Richardson
(74) *Attorney, Agent, or Firm* — Fox Rothschild LLP; Carol E. Thorstad-Forsyth

(57) ABSTRACT

An arrangement (10) comprising a first conductive antenna element (20), comprising at least one first slot (30; 31, 32, 33, 34; 35, 36) arranged in the first conductive antenna element (20), and a second conductive antenna element (80), comprising at least one second slot (90; 91, 92, 93, 94; 31; 32, 33, 34) arranged in the second conductive antenna element (80), is disclosed. At least one second slot (90; 91, 92) arranged in the second conductive antenna element (80) is coupled with at least one first slot (30; 35, 36) arranged in the first conductive antenna element (20) by means of at least one conductor (111, 112; 113, 114, 115, 116).

17 Claims, 6 Drawing Sheets

(51) Int. Cl.

| | |
|---|---|
| ***H01Q 9/04*** | (2006.01) |
| ***H01Q 13/10*** | (2006.01) |
| ***H01Q 1/24*** | (2006.01) |
| ***H01Q 21/06*** | (2006.01) |

(52) U.S. Cl.
CPC ..... *H01Q 13/10* (2013.01); *H01Q 13/106* (2013.01); *H01Q 21/064* (2013.01); *H01Q 21/24* (2013.01)

(56) References Cited

U.S. PATENT DOCUMENTS

| | | | |
|---|---|---|---|
| 9,225,070 | B1 | 12/2015 | Zeweri et al. |
| 2005/0140552 | A1 | 6/2005 | Lafleur |
| 2015/0270617 | A1 | 9/2015 | Fakharzadeh et al. |
| 2015/0288071 | A1 | 10/2015 | Toyao |

OTHER PUBLICATIONS

International Search Report dated Jan. 15, 2018 and prepared for PCT/EP2017/077315.

International Preliminary Report on Patentability dated Jan. 10, 2018 for PCT/EP2017/077315.

Lee, R.Q., et al., "Experimental Study of the Two-Layer Electromagnetically Coupled Rectangular Patch Antenna," IEEE Transactions on Antennas and Propagation, IEEE Service Center, Piscataway, NJ, US, vol. 38, No. 8, Aug. 1, 1990, pp. 1298-1302, XP002272547, ISSN: 0018-926X, DOI: 10.1109/8.56971.

* cited by examiner

ARRANGEMENT COMPRISING ANTENNA ELEMENTS

CROSS-REFERENCE TO RELATED APPLICATION

The present application is the U.S. National Phase of International Patent Application No. PCT/EP2017/077315, filed on Oct. 25, 2017 and entitled "ARRANGEMENT COMPRISING ANTENNA ELEMENTS," which claims priority to Swedish Patent Application No. 1651391-3, filed on Oct. 25, 2016 and entitled "ARRANGEMENT COMPRISING ANTENNA ELEMENTS," the contents of which are incorporated herein by reference in their entireties.

TECHNICAL FIELD

The present invention generally relates to the field of antennas. Specifically, the present invention relates to an arrangement comprising conductive antenna elements which for example may be employed in an antenna unit or antenna array, e.g., including or being constituted by a broadband antenna.

BACKGROUND

Multiband broadband antenna systems are antenna systems which may provide wireless signals in multiple radio frequency bands. Such antenna systems may for example be used in wireless communication systems, such as, for example, a system based on GSM, GPRS, EDGE, UMTS, LTE, and/or WiMax. Such antenna systems may include a plurality of antenna elements. The antenna elements may be comprised in or constitute an antenna or antenna unit and may for example be in the form of discs or plates, or disc-like or plate-like structures, which antenna elements may be arranged to provide a desired or required radiated—and received—antenna signal beamwidth and azimuth scan angle. A relatively high bandwidth of such an antenna or antenna unit may be desired or required in different applications.

SUMMARY

In view of the foregoing, a concern of the present invention is to facilitate for providing an antenna or antenna unit having a relatively high bandwidth.

To address at least one of this concern and other concerns, an arrangement in accordance with the independent claim is provided. Preferred embodiments are defined by the dependent claims.

According to a first aspect there is provided an arrangement comprising a first conductive antenna element, comprising at least one first slot arranged in the first conductive antenna element, and a second conductive antenna element, comprising at least one second slot arranged in the second conductive antenna element. At least one second slot arranged in the second conductive antenna element is coupled with at least one first slot arranged in the first conductive antenna element by means of at least one conductor.

Embodiments of the present invention are based on providing a plurality of conductive antenna elements, wherein each of at least two conductive antenna elements comprises at least one slot arranged in the respective ones of the at least two of the conductive antenna elements, and wherein a coupling or connection (possibly, a direct coupling or connection) between at least one slot of a first conductive antenna element and at least one slot of a second conductive antenna element is provided. Conductive antenna elements comprising one or more slots arranged therein may be referred to as slotted conductive antenna elements. Previous slotted conductive antenna elements may have a double resonance, e.g., radio frequency (RF) resonance, at or about a frequency that may be determined primarily by the size of the slotted conductive antenna element and the length of the slot(s). The frequency at which the slotted conductive antenna element has a resonance may be referred to as a resonant frequency. As known in the art, a resonant frequency of an RF antenna is the frequency where the capacitive reactance of the RF antenna and inductive reactance of the RF antenna are cancelling each other out. RF antennas are often designed to operate around their resonant frequency, which entails that there may be only a certain bandwidth over which the RF antenna can operate efficiently. Outside this bandwidth, the capacitive and inductive reactance of the RF antenna may be too high for satisfactory operation of the RF antenna. For previous slotted conductive antenna elements as mentioned in the foregoing, an increased bandwidth and capacitive tuning may be achieved by adding a parasitic element above or below and at a distance from the slotted conductive antenna element. It has been found by the inventor that in order to excite a clear third resonance, e.g., an RF resonance, one or more slots may be included in the parasitic element, which slots may be—possibly directly—connected or coupled to slot of the slotted conductive antenna element. By (e.g., directly) connecting or coupling the slot of the slotted conductive antenna element with the slot of the parasitic element, a clear third resonance may be obtained, which may be used to increase the bandwidth of the antenna or antenna unit that comprises or is constituted by the slotted conductive antenna element, over which bandwidth the antenna or antenna unit can operate efficiently. The slot of the slotted conductive antenna element may be connected or coupled with the slot of the parasitic element by means of one or more conductors, or transmission lines, which for example may be configured to transmit signals, such as, for example, microwave signals. When the slot of the slotted conductive antenna element is fed with such a signal, a current may flow between the slotted conductive antenna element and the parasitic element via the connection or coupling between the slot of the slotted conductive antenna element and the slot of the parasitic element, whereby the parasitic element may be excited or fed by the signal.

In the light of the foregoing, an arrangement according to the first aspect—by means of the at least one second slot arranged in the second conductive antenna element being coupled with at least one first slot arranged in the first conductive antenna element—may facilitate excitation of a clear third resonance, e.g., an RF resonance. And as per the discussion in the foregoing, the third resonance may increase the bandwidth of an antenna or antenna unit that comprises or is constituted by the arrangement.

Furthermore, such an increased bandwidth may be achieved while keeping the overall size of the antenna or antenna unit relatively small. Generally, the bandwidth (and gain) of an antenna may be dependent on the size of the antenna. Since the bandwidth of an antenna or antenna unit, which comprises or is constituted by the arrangement according to the first aspect, may be increased by means of the at least one second slot arranged in the second conductive antenna element being coupled with at least one first slot arranged in the first conductive antenna element, the overall size of the antenna or antenna unit may be kept relatively small.

The arrangement according to the first aspect could for example be employed in an antenna unit or antenna array in accordance with the antenna units and antenna array disclosed in FIGS. 4 to 6 in international application PCT/EP2015/053322, publication no. WO 2015/124573 A1, Applicant Filtronic Wireless AB, which is incorporated herein by reference in its entirety.

It is contemplated that the excitation of a clear third resonance, e.g., an RF resonance, in the arrangement according to the first aspect may be further facilitated by appropriate selection of the position(s) at or along the at least one slot arranged in the first conductive antenna element and/or the position(s) at or along the at least one slot arranged in the second conductive antenna element at which the at least one slot arranged in the second conductive antenna element is connected or coupled to the at least one slot arranged in the first conductive antenna element.

The at least one conductor by means of which at least one second slot arranged in the second conductive antenna element is coupled with at least one first slot arranged in the first conductive antenna element may for example comprise one or more wires, e.g., comprising copper and/or another appropriate electrically conductive material, and/or one or more cables.

The arrangement may possibly comprise one or more additional conductive antenna elements. Each of the one or more additional conductive antenna elements may, just as the first conductive antenna element and the second conductive antenna element, comprise at least one slot arranged therein. Any such possible additional conductive antenna element may be arranged and/or configured in the same or in a similar way as the first conductive antenna element and/or the second antenna element as described herein. For example, the arrangement could comprise a third conductive antenna element comprising at least one slot arranged therein, wherein at least one slot arranged in the third conductive antenna element may be coupled with at least one first slot arranged in the first conductive antenna element and/or with at least one second slot arranged in the second conductive antenna element, by means of at least one conductor.

According to another example, the arrangement may comprise one or more additional conductive antenna elements, wherein each of the one or more additional conductive antenna elements comprises at least one slot arranged therein, and the first conductive antenna element (or the second conductive antenna element) may comprise a plurality of slots arranged therein, which plurality of slots may be arranged at a distance from each other. At least one slot of the second conductive antenna element (or the first conductive antenna element) and at least one slot of each or any one of the one or more additional conductive antenna elements may be coupled with respective ones of the plurality of slots of the first conductive antenna element (or the second conductive antenna element). Thus, one antenna element, which may be referred to as a primary antenna element, could be arranged with multiple slots, and the slot(s) of respective ones of several other antenna elements, which may be referred to as secondary antenna elements, could be coupled with the multiple slots of the one (primary) antenna element, with the slot(s) of the respective ones of the secondary antenna elements being coupled to one or more associated slots of the primary antenna element. The slot(s) of the respective ones of the secondary antenna elements may be coupled to different slot(s) of the primary antenna element.

Possibly, one of the first conductive antenna element and the second conductive antenna element may be configured so as to serve as a reflector with respect to (e.g., RF waves) radiated from the other one of the first conductive antenna element and the second conductive antenna element (and possibly also any additional conductive antenna elements which may be comprised in the arrangement). For example, the primary antenna element described in the foregoing could be configured so as to serve as a reflector with respect to (e.g., RF waves) radiated from at least some of the secondary antenna elements. The one of the first conductive antenna element and the second conductive antenna element configured so as to serve as a reflector may be referred to as a ground plane.

An RF signal may be fed to the primary antenna element, wherein RF waves may be radiated from the slots of the primary antenna element. Thereby, a current may flow between the primary antenna element and each of the secondary antenna elements via at least one conductor coupling the slot(s) of the respective ones of the secondary antenna elements to one or more associated slots of the primary antenna element, whereby the secondary antenna elements may be excited or fed by means of the RF signal.

The at least one first slot arranged in the second conductive antenna element may for example be coupled with at least one second slot arranged in the first conductive antenna element by means of at least one pair of conductors. The at least one pair of conductors may form a transmission line for transmission of signals (e.g., microwave signals) from the at least one second slot arranged in the second conductive antenna element to the at least one first slot arranged in the first conductive antenna element, or vice versa.

The inductance of the conductor or transmission line used to provide a (possibly direct) connection or coupling between the at least one first slot arranged in the first conductive antenna element and the at least one second slot arranged in the second conductive antenna element may be relatively high. This potentially high impedance may be addressed for example by adjusting the conductor or transmission line width and/or conductor or transmission line separation (which may be referred to as the slot gap). Occurrence of any possible unwanted resonance corresponding to a loop around the first conductive antenna element, through the one or more conductor or transmission lines and along the at least one slot of the second conductive antenna element may possibly be reduced or even avoided with careful choice of design parameters, such as, for example, the length and position of the slot(s).

The first conductive antenna element, the second conductive antenna element and/or any possible additional conductive antenna element in the arrangement may for example comprise one or more Printed Circuit Boards (PCBs) and/or metallic plates or discs (e.g., one or more plates or discs at least in part made of aluminium (or aluminum) or a similar metal or metallic material).

The first conductive antenna element and the second conductive antenna element may be arranged in spaced relation with respect to each other. Thus, the first conductive antenna element and the second conductive antenna element may be arranged at a distance from each other.

In the context of the present application, by a slot in the first conductive antenna element or the second conductive antenna element (e.g., the at least one first slot of the first conductive antenna element, or the at least one second slot in the second conductive antenna element), it is meant a hole, a slit, an aperture, an indentation or groove, or the like, in the first conductive antenna element or the second conductive antenna element, which hole, slit, aperture or indentation or groove or the like may have a generally elongated shape. The slot may hence have a generally elongated shape. Possibly, a slot in the first conductive antenna element or the second conductive antenna element could comprise, or be constituted by, a hole, slit or aperture followed by an indentation or groove or the like in the first conductive antenna element or the second conductive antenna element.

The first conductive antenna element and the second conductive antenna element may form a radiating antenna. To that end, an RF signal may be fed to at least one of the first conductive antenna element and second conductive antenna element, wherein RF waves may be radiated from the at least one first slot and/or the at least one second slot of the first conductive antenna element and the second conductive antenna element, respectively.

Each or any of the at least one first slot of the first conductive antenna element may have at least one associated feed point arranged at the respective first slot. Each or any of the at least one second slot of the second conductive antenna element may have at least one associated feed point arranged at the respective second slot. The feed points may be arranged to be fed with (or arranged so as to be capable of receiving) RF signals having a selected wavelength or a wavelength within a selected wavelength range having a selected center wavelength.

When one of the first conductive antenna element and second conductive antenna element is fed by an RF signal in such a manner, a current may flow between the first conductive antenna element and second conductive antenna element via the at least one conductor coupling the at least one first slot arranged in the second conductive antenna element with at least one second slot arranged in the first conductive antenna element, whereby the other one of the first conductive antenna element and second conductive antenna element may be excited or fed by means of the RF signal.

The selected wavelength range may for example correspond to one the frequency ranges 617 MHz-894 MHz, 694 MHz-960 MHz, 1425 MHz-2200 MHz, 1695 MHz-2690 MHz, 3300 MHz-3700 MHz, or 5000 MHz-6000 MHz. The wavelength ranges corresponding to these frequency ranges may have a center wavelength of (about) 397 mm, 363 mm, 166 mm, 137 mm, 86 mm, and 55 mm, respectively.

As indicated in the foregoing, each of the at least one first slot of the first conductive antenna element and the at least one second slot of the second conductive antenna element may be excited by an associated feed point arranged at the respective slot. The feed point may in alternative be referred to as a terminal (of an associated slot). Possibly, each of the at least one first slot of the first conductive antenna element could have two or more associated feed points arranged at the respective first slot, and each of the at least one second slot of the second conductive antenna element could have two or more associated feed points arranged at the respective second slot. And each of the at least one first slot of the first conductive antenna element and the at least one second slot of the second conductive antenna element could be excited by the associated feed points (e.g., a feed point pair, or terminal pair) arranged at the respective slot.

A microstrip line or the like, which may cross the width of the at least one first slot of the first conductive antenna element and/or the at least one second slot of the second conductive antenna element may be used to generate a desired or required voltage across the associated feed points arranged at the respective slot. The microstrip line may be connected to ground.

A microstrip line associated with the at least one first slot arranged in the first conductive antenna element and a microstrip line associated with the at least one second slot arranged in the second conductive antenna element may be connected, e.g., via a coaxial cable, to a voltage source. In alternative or in addition, a voltage source may be directly connected between the associated feed points arranged at the respective slot(s) of the first conductive antenna element and/or the second conductive antenna element.

As mentioned in the foregoing, a slot in the first conductive antenna element or the second conductive antenna element may have a generally elongated shape, and may extend in a direction of a longitudinal axis of the slot. The slot may for example have a rectangular, or generally rectangular, shape, but this is not required. For example, the slot may be exhibit a tapered form, wherein the width of the slot increases or decreases in a direction along the length of the slot. A width of the slot may for example be 0.01 times, or about 0.01 times, the selected wavelength or the selected center wavelength.

At least one of the first conductive antenna element and the second conductive antenna element may comprise a surface on which the at least one first slot or the at least one second slot, respectively, is arranged. The surface may have a perimeter, or circumference, at least in part defining an edge of the first conductive antenna element or the second conductive antenna element, respectively. The at least one first slot or the at least one second slot, respectively, may be extending from a point on the surface within the perimeter to the edge of the first conductive antenna element or the second conductive antenna element, respectively. Thus, the at least one first slot and/or the at least one second slot may extend from an edge of the first conductive antenna element or the second conductive antenna element, respectively, and on or across the surface on which the at least one first slot or the at least one second slot, respectively, is arranged. As indicated in the foregoing, the at least one first slot and/or the at least one second slot may exhibit a tapered form, wherein the width of the at least one first slot and/or the at least one second slot increases or decreases in a direction along the length of the respective slot(s). For example, the slot(s) may be relatively wide at the edge of the first conductive antenna element or the second conductive antenna element, respectively, and become more narrow as the slot(s) extends on or across the surface on which the at least one first slot or the at least one second slot, respectively, is arranged, away from the edge (or vice versa). A larger width of the slot may increase a reactance of the respective one of the first conductive antenna element or the second conductive antenna element, and thereby make it more inductive, while a smaller width of the slot will make the respective one of the first conductive antenna element or the second conductive antenna element more capacitive. Possibly, the width of the slot(s) may vary along at least a portion of the length of the slot(s), or even along the entire length of the slot(s).

At least one first slot arranged in the first conductive antenna element may extend along a first axis. At least one second slot arranged in the second conductive antenna element may extend along a second axis. The first conductive antenna element and the second conductive antenna element may be arranged (e.g., in spaced relation) with respect to each other such that the first axis and the second axis are parallel, or substantially parallel.

The first axis and the second axis may hence not necessarily be exactly parallel. By the first axis—along which at least one first slot arranged in the first conductive antenna element extends—and the second axis—along which at least one second slot arranged in the second conductive antenna element extends—being substantially parallel, it is meant that there may be an angle between the first axis and the second axis. An angle A between the first axis and the second axis may for example be in a range 0°<A<5°, or 0°<A<10° or more. By arranging slots in the first and second conductive antenna elements, respectively, such that they are extending in a parallel or substantially parallel fashion, the polarizations of the first conductive antenna element and the second conductive antenna element may be the same, or substantially the same.

Each of the first conductive antenna element and the second conductive antenna element may be plate-shaped, or disc-shaped. The first conductive antenna element and/or the second conductive antenna element may for example comprise a plate or a disc, or a plate-like or disc-like element. The first conductive antenna element may be arranged above or below the second conductive antenna element and at a distance from the second conductive antenna element. The distance may for example be in a range from 0.15 times the selected wavelength or the selected center wavelength to 0.35 times the selected wavelength or the selected center wavelength. This distance may be the same, or substantially the same, as the length of one or more conductors coupling the at least one first slot of the first conductive antenna element and the at least one second slot of the second conductive antenna element. Generally, the at least one first slot of the first conductive antenna element and the at least one second slot of the second conductive antenna element may be coupled with each other by means of one or more conductors which for example may have a length in a range from 0.15 times the selected wavelength or the selected center wavelength to 0.35 times the selected wavelength or the selected center wavelength.

The slot(s) of the first conductive antenna element and the second conductive antenna element may be configured in different manners so as to exhibit a selected shape, size, and/or dimension, for example, which for example may facilitate in tailoring the electric field strength originating from the respective slot or slots when it or they are fed with RF signals such as described in the foregoing.

For example, at least one of the first conductive antenna element and the second conductive antenna element may comprise a surface on which the at least one first slot or the at least one second slot, respectively, may be arranged. The surface may have a perimeter at least in part defining an edge of the first conductive antenna element or the second conductive antenna element, respectively.

The at least one first slot or the at least one second slot, respectively, may be extending on the surface within the perimeter but without extending to the edge of the first conductive antenna element or the second conductive antenna element, respectively. Thus, the at least one first slot or the at least one second slot may not extend to the edge of the first conductive antenna element or the second conductive antenna element, respectively. The at least one first slot and/or the at least one second may for example have a length that is in a range from 0.35 times the selected wavelength or the selected center wavelength to 0.65 times the selected wavelength or the selected center wavelength. For example, the at least one first slot and/or the at least one second slot may have a length that is 0.5, or about 0.5, times the selected wavelength or the selected center wavelength.

In addition, or in alternative, the at least one first slot or the at least one second slot, respectively, may be extending from a point on the surface within the perimeter to the edge of the first conductive antenna element or the second conductive antenna element, respectively. The at least one first slot and/or the at least one second slot may for example have a length that is in a range from 0.15 times the selected wavelength or the selected center wavelength to 0.35 times the selected wavelength or the selected center wavelength. For example, the at least one first slot and/or the at least one second slot may have a length that is 0.25, or about 0.25, times the selected wavelength or the selected center wavelength.

The at least one first slot or the at least one second slot, respectively, may be non-planar, or planar. One or more of the at least one first slot or the at least one second slot, respectively, could be planar, and one or more other ones of the at least one first slot or the at least one second slot, respectively, could be non-planar.

The first conductive antenna element and/or the second conductive antenna element may be planar, or substantially planar. However, this is not required, and according to one or more embodiments of the present invention, the first conductive antenna element and/or the second conductive antenna element may be non-planar. For example, the first conductive antenna element and/or the second conductive antenna element may comprise a planar portion that is arranged (e.g., bent and/or curved) so as to be at an angle to another planar portion of the respective conductive antenna element. The above-mentioned surface may comprise a first planar surface portion and a second planar surface portion. The first planar surface portion and second planar surface portion may be contiguous, or adjoining each other. The first planar surface portion and the second planar surface portion may be arranged in relation to each other such that the first planar surface portion is arranged at an angle to the second planar surface portion, or vice versa. The at least one first slot or the at least one second slot, respectively, may be extending across from the first planar surface portion to the second planar surface portion, or vice versa. The first planar surface portion may for example be arranged at an angle of 90 degrees, or about 90 degrees, to the second planar surface portion, or vice versa. It is however to be understood that this is according to an example, and that the first planar surface portion could be arranged at an angle smaller or larger than 90 degrees to the second planar surface portion, or vice versa. The part of the at least one first slot or the at least one second slot, respectively, that is extending on the first planar surface portion could for example comprise, or be constituted by, a hole or a slit, and the part of the at least one first slot or the at least one second slot, respectively, that is extending on the second planar surface portion could for example comprise, or be constituted by, an indentation or groove or the like in the first conductive antenna element or the second conductive antenna element, respectively. For example, the first planar surface portion could be arranged closer to the edge of the first conductive antenna element or the second conductive antenna element, respectively, than the second planar surface portion.

The first conductive antenna element may comprise at least two first slots arranged in the first conductive antenna element, and/or the second conductive antenna element may comprise at least two second slots arranged in the second conductive antenna element. At least one of the first conductive antenna element and the second conductive antenna element may comprise a surface on which the at least two first slots or the at least two second slots, respectively, may be arranged. The surface may have a perimeter at least in part defining an edge of the first conductive antenna element or the second conductive antenna element, respectively. The at least two first slots or the at least two second slots, respectively, may be extending on the surface within the perimeter but without extending to the edge of the first conductive antenna element or the second conductive antenna element, respectively. At least two of the first slots or at least two of the second slots, respectively, may be extending on the surface so as to intersect each other at least at one region on the surface. For example, the first slots or the second slots which are intersecting on the surface of the first conductive antenna element or the second conductive antenna element, respectively, may form a cross shape (e.g., a shape in accordance with an X-mark), or a V-shape, for example as seen from above the surface.

Each of the first conductive antenna element and the second conductive antenna element may comprise a surface on which the at least one first slot and the at least one second slot, respectively, may be arranged. The surface may have a perimeter at least in part defining an edge of the first conductive antenna element and the second conductive antenna element, respectively. The at least one first slot and the at least one second slot, respectively, may be extending on the surface of the first conductive antenna element and the second conductive antenna element, respectively, within the respective perimeter but without extending to the edge of the first conductive antenna element and the second conductive antenna element, respectively. The said at least one first slot and the at least one second slot may be coupled with each other by means of at least one conductor. The said at least one first slot and the at least one second slot may for example be coupled with each other by means of at least one conductor extending between the at least one first slot at a midpoint along the length of the at least one first slot and the at least one second slot at a midpoint along the length of the at least one second slot. By a midpoint along the length of the at least one first slot or the at least one second slot, it is not necessarily meant an exact midpoint along the length of the at least one first slot or the at least one second slot, but it may refer to a point along the length of the at least one first slot or the at least one second slot that is at a distance along the length of the at least one first slot or the at least one second slot from the exact midpoint of a few percent of the total length of the at least one first slot or the at least one second slot or more, e.g., up to 10% of the total length of the at least one first slot or the at least one second slot.

The first conductive antenna element may comprise at least two first slots arranged in the first conductive antenna element. The first conductive antenna element may comprise a surface on which the at least two first slots may be arranged. The surface may have a perimeter at least in part defining an edge of the first conductive antenna element. The at least two first slots may be extending on the surface within the perimeter but without extending to the edge of the first conductive antenna element. At least two of the first slots may be extending on the surface so as to intersect each other at least at one region on the surface. The second conductive antenna element may comprise at least two second slots arranged in the second conductive antenna element. The second conductive antenna element may comprise a surface on which the at least two second slots may be arranged. The surface may have a perimeter at least in part defining an edge of the second conductive antenna element. Each of the at least two second slots may be extending from a point on the surface within the perimeter to the edge of the second conductive antenna element. At least one of the at least two intersecting first slots may be coupled with at least two of the second slots by means of respective ones of at least two conductors. For example, each of the at least two second slots may be extending from a center point on the surface to the edge of the second conductive antenna element. The at least two second slots may be rotationally symmetrically arranged on the surface of the second conductive antenna element. At least one of the at least two intersecting first slots may be coupled with each of a pair of oppositely arranged second slots by means of respective ones of at least two conductors.

According to a second aspect there is provided an antenna or antenna unit, which comprises or is constituted by at least one arrangement according to the first aspect.

The antenna or antenna unit may be referred to as an antenna array, and may comprise a plurality of arrangements according to the first aspect, which may be arranged in an array. For example, a plurality of arrangements according to the first aspect may arranged along a line, or in a row, possibly so that the distances between adjacent ones of the arrangements are the same, or substantially the same.

In addition, or in alternative, the antenna or antenna unit could comprise the primary antenna element and the secondary antenna elements as described in the foregoing, possibly with the primary antenna element being configured so as to serve as a reflector with respect to (e.g., RF waves) radiated from the secondary antenna elements, as described in the foregoing.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the invention will be described below with reference to the accompanying drawings.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments are provided by way of example so that this disclosure will convey the scope of the present invention to those skilled in the art.

FIGS. 1 to 5 are schematic views from the above illustrating conductive antenna elements 20 according to different embodiments of the present invention. Each of the conductive antenna elements illustrated in FIGS. 1 to 5 may comprise or constitute the first conductive antenna element and/or the second conductive antenna element. Thus, any one of the conductive antenna elements 20 illustrated in FIGS. 1 to 5 may be comprised in an arrangement according to an embodiment of the present invention, and may comprise or constitute the first conductive antenna element and/or the second conductive antenna element of the arrangement.

Figure 3:
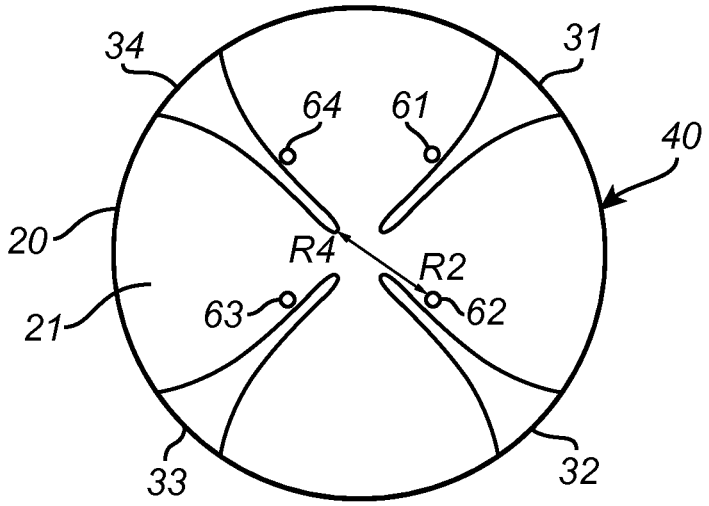
Figure 4:
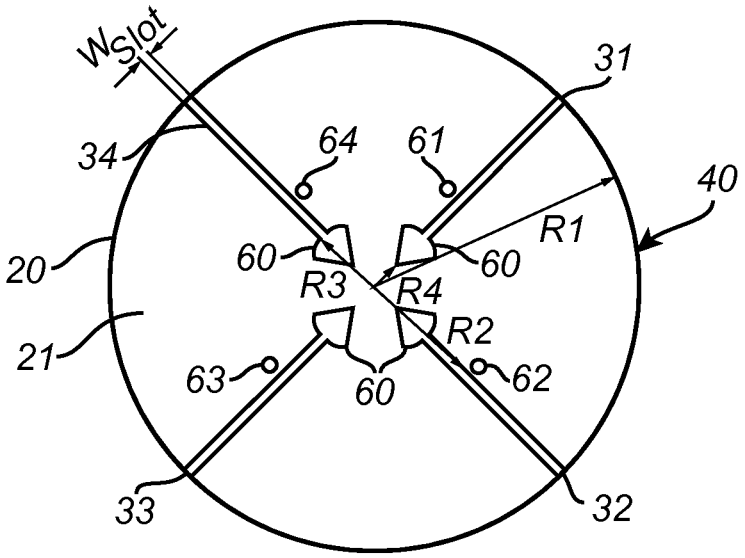
Figure 5:
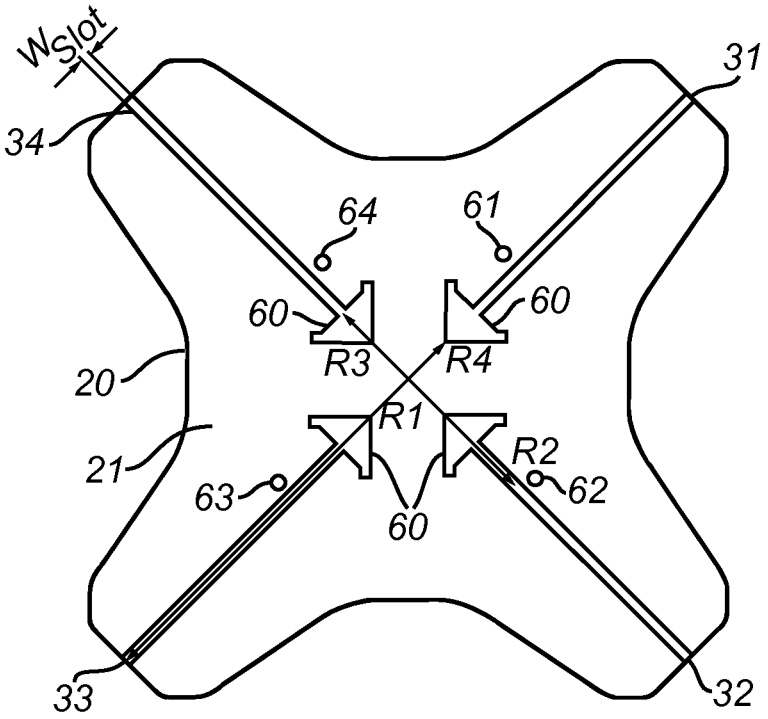

In accordance with the respective embodiments of the present invention illustrated in FIGS. 1 to 5, each of the conductive antenna elements 20 comprises a plate or disc, and in accordance with the respective embodiments of the present invention illustrated in FIGS. 1 to 4, each of the conductive antenna elements 20 have a circular, or substantially circular, or oval, shape. It is however to be understood that the configurations of the conductive antenna elements 20 illustrated in FIGS. 1 to 5 are according to examples, and that it is not required for the conductive antenna element(s) to be plate-shaped, or disc-shaped, or having a (substantially) circular or oval shape. Other shapes than circular or oval are possible, for example such as illustrated in FIG. 5 and in FIG. 9.

Figure 1:
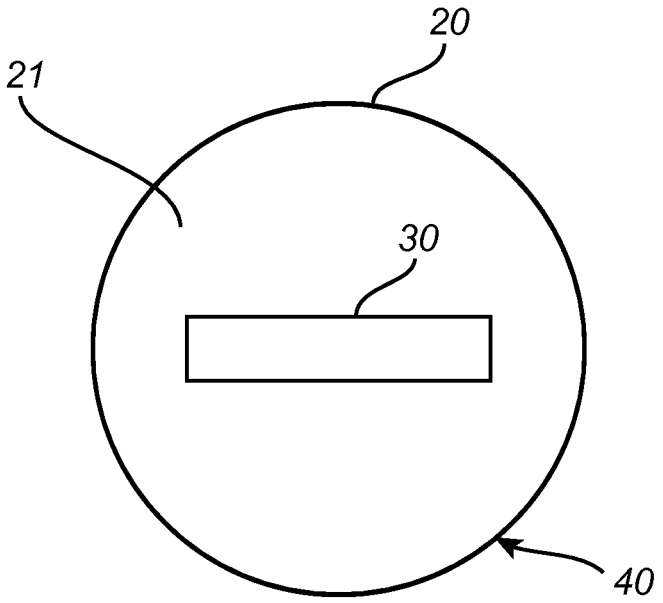
FIGS. 1 to 5 are schematic views from the above illustrating conductive antenna elements according to different embodiments of the present invention.

FIG. 1 illustrates a conductive antenna element 20 which comprises a slot 30 arranged in the conductive antenna element 20. The conductive antenna element 20 comprises a surface 21 on which the slot 30 is arranged. In accordance with the embodiment of the present invention illustrated in FIG. 1, the slot 30 has a rectangular shape, and is in the form of an indentation or groove or the like in one side of the conductive antenna element 20. It is however to be understood that the slot 30 could have another shape than a rectangular shape, and further that the slot 30 in alternative, or in addition, could be in the form of a hole, a slit, an aperture or the like in the conductive antenna element 20. As illustrated in FIG. 1, a center of the slot 30 may coincide with a center of the surface 21 of the conductive antenna element 20, but this is not required, and the slot 30 could be arranged at another location at the surface 21 of the conductive antenna element 20. Also, the conductive antenna element 20 could comprise more than one slot 30. The surface 21 has a perimeter 40 defining an edge (not indicated by reference numeral in FIG. 1) of the conductive antenna element 20. As illustrated in FIG. 1, the slot 30 may be extending on the surface 21 within the perimeter 40 but without extending to the edge of the conductive antenna element 20.

Figure 2:
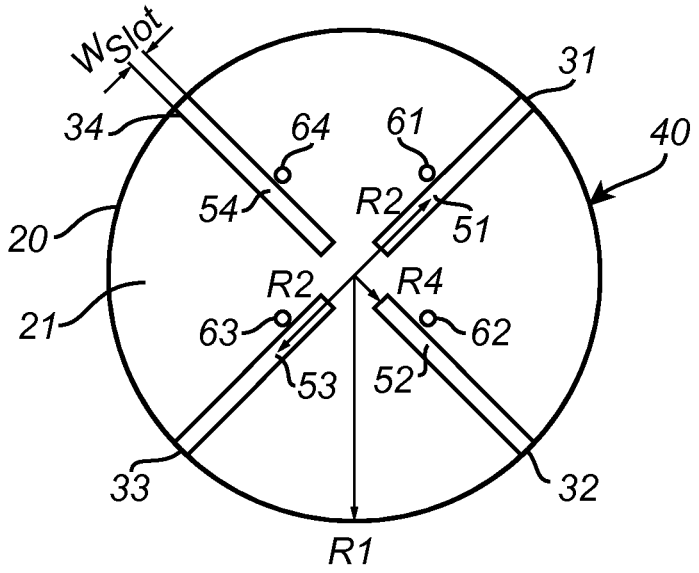

FIG. 2 illustrates a conductive antenna element 20 according to an embodiment of the present invention, which conductive antenna element 20 comprises four slots 31, 32, 33, 34. The conductive antenna element 20 comprises a surface 21 on which the slots 31, 32, 33, 34 are arranged. In accordance with the embodiment of the present invention illustrated in FIG. 2, and as illustrated in FIG. 2, the slots 31, 32, 33, 34 are arranged in a rotational symmetric manner in the conductive antenna element 20.

Similar to the slot 30 of the conductive antenna element 20 illustrated in FIG. 1, each of the slots 31, 32, 33, 34 has a rectangular shape, and is in the form of an indentation or groove or the like in one side of the conductive antenna element 20. It is however to be understood that any one of the slots 31, 32, 33, 34 could have another shape than a rectangular shape, and further that any one of the slots 31, 32, 33, 34, in alternative, or in addition, could be in the form of a hole, a slit, an aperture or the like in the conductive antenna element 20.

The surface 21 has a perimeter 40 defining an edge (not indicated by reference numeral in FIG. 2) of the conductive antenna element 20. As indicated in FIG. 2, each of the slots 31, 32, 33, 34 extends from a point on the surface 21 within the perimeter 40 to the edge of the conductive antenna element 20. In accordance with the embodiment of the present invention illustrated in FIG. 2, each of the slots 31, 32, 33, 34 extends between the perimeter 40 (and the edge) of the conductive antenna element 20 and a rotational symmetry center of the conductive antenna element 20.

Each of the slots 31, 32, 33, 34 has an associated feed point 51, 52, 53, 54, respectively, arranged at the respective ones of the slot 31, 32, 33 and 34. The feed points 51, 52, 53, 54 may be arranged to be fed with radio frequency (RF) signals having a selected wavelength or a wavelength within a selected wavelength range having a selected center wavelength.

For example, the feed points 51 and 53 associated with the pair of oppositely arranged slots 31 and 33, respectively, may be arranged to be fed with an RF signal such that a main radiation propagation direction of the conductive antenna element 20 (or the arrangement comprising the conductive antenna element 20, or an antenna or antenna unit comprising the arrangement) is along a rotational symmetry axis of the conductive antenna element 20.

By arranging the slots 31, 32, 33, 34 in the conductive antenna element 20 in a rotational symmetrical manner, the electric field strength originating from the slots of one pair of oppositely arranged slots (e.g., the slots 31 and 33, or the slots 32 and 34), when fed with RF signals of equal phase (or substantially equal phase; a deviation of up to about 10 degrees may be contemplated), may be reduced approximately where the slots of the other (or another) pair of oppositely arranged slots are arranged. Thereby, any interfering effect of the electric field from the slots of one pair of oppositely arranged slots upon the other (or another) pair of oppositely arranged slots may be reduced. Thus, isolation between two polarizations of the conductive antenna element 20 may be increased.

Similarly, by arranging the slots 31, 32, 33, 34 in the conductive antenna element 20 in a rotational symmetrical manner, the electric field strength originating from the slots of one pair of oppositely arranged slots (e.g., the slots 31 and 33, or the slots 32 and 34), when fed with RF signals of equal amplitude (or substantially equal amplitude), may be reduced approximately where the slots of the other (or another) pair of oppositely arranged slots are arranged. Thereby, any interfering effect of the electric field from the slots of one pair of oppositely arranged slots upon the other (or another) pair of oppositely arranged slots may be reduced. In other words, isolation between two polarizations of the conductive antenna element 20 may be increased.

If the slots of one pair of oppositely arranged slots (e.g., the slots 31 and 33, or the slots 32 and 34) would be fed with RF signals of equal phase and equal amplitude (or substantially equal phase and/or substantially equal amplitude), the electric field strength originating from the slots may be at a minimum approximately where the slots of the other (or another) pair of oppositely arranged slots are arranged, such that any interfering effect of the electric field from the slots of one pair of oppositely arranged slots upon the other (or another) pair of oppositely arranged slots may be negligible or even (essentially) absent.

Each of the slots 31, 32, 33, 34 have a width $W_{slot}$ (only the width of the slot 34 is indicated in FIG. 2). The width of the slot may for example be 0.01 times, or about 0.01 times, of the selected wavelength or the selected center wavelength of the RF signals with which the feed points 51, 52, 53, 54 may be arranged to be fed.

The conductive antenna element 20 comprises feeding termination points 61, 62, 63, 64, which as illustrated in FIG. 2 may be located on the surface 21. Each of the feed points 51, 52, 53, 54—and each of the slots 31, 32, 33, 34—is associated with a respective one of the feeding termination points 61, 62, 63, 64. Each of the feeding termination points 61, 62, 63, 64 is arranged at its associated slot 31, 32, 33 and 34, respectively.

An antenna having a plurality of feed points—such as, for example, the conductive antenna element 20—will have an active impedance, which may be referred to as driving point impedance. Consider for example the slots 31 and 33 of the conductive antenna element 20. If these slots would be excited, or fed with RF signals, having the same phase and magnitude, radiation from the conductive antenna element 20 (or the arrangement comprising the conductive antenna element 20, or an antenna or antenna unit comprising the arrangement) would be along the rotational symmetry axis of the conductive antenna element 20. In order for the conductive antenna element 20 to obtain a desired impedance, mutual coupling between, for example, the slots 31 and 33, should be considered. That impedance may be referred to as an active impedance or driving point impedance, which may be determined according to the following. Assume that the slots 31 and 33 are fed with feed currents $I_a$ and $I_C$, respectively. If the impedances of the slots 31 and 33 are $Z_{aa}$ and $Z_{cc}$, respectively, and the mutual impedance is $Z_{ac}=Z_{ca}$, the active impedance of the slot 31 is $Z_{a,\ active}=Z_{aa}+Z_{ac}(I_c/I_a)$. When $I_a=I_c$, for example with equal phase and magnitude, the active impedance becomes $Z_{a,\ active}=Z_{aa}+Z_{ac}$.

As illustrated in FIGS. 2 to 4, the perimeter 40 of the conductive antenna element 20 may be located at a distance $R_1$ from the rotational symmetry axis of the conductive antenna element 20, and each of the feed points 51, 52, 53, 54 may be located at a distance $R_2$ from the rotational symmetry axis of the conductive antenna element 20. The relation between $R_1$ and $R_2$ is $R_2<R_1$. $R_2$ may for example be less than 0.5 times $R_1$, i.e. $R_2<0.5R_1$. The smaller the distance $R_2$, the smaller the impedance of the slots 31, 32, 33, 34 may be. Thus, by modifying the relation between $R_1$ and $R_2$ it may be facilitated to achieve the desired active impedance.

Furthermore, as illustrated in FIGS. 2 to 4, each of the slots 31, 32, 33, 34 may have an end at a distance $R_4$ from the rotational symmetry axis of the conductive antenna element 20. The distance $R_4$ may be less than the distance $R_2$, i.e. $R_4<R_2$ may hold. For operation of the conductive antenna element 20 (or the arrangement comprising the conductive antenna element 20, or an antenna or antenna unit comprising the arrangement) in the frequency band from 1710 MHz to 2690 MHz, the following may for example hold: $R_1$=32 mm, $R_2$=13 mm, $R_4$=6.5 mm.

The total length of the respective ones of the slots 31, 32, 33, 34 (which, e.g., may be provided by the difference between $R_1$ and $R_4$) may affect the frequency of operation of the conductive antenna element 20 (or the arrangement comprising the conductive antenna element 20, or an antenna or antenna unit comprising the arrangement). For example, for operation of the conductive antenna element 20 (or the arrangement comprising the conductive antenna element 20, or an antenna or antenna unit comprising the arrangement) in the frequency band from 1710 MHz to 2690 MHz, the conductive antenna element 20 may be arranged such that the length of the slots 31, 32, 33, 34 is between (about) 20 mm and 35 mm, which may correspond to 0.15 to 0.25 wavelengths at a center frequency of 2200 MHz.

FIGS. 3 to 5 illustrate conductive antenna elements 20 according to different embodiments of the present invention. The conductive antenna element 20 illustrated in each of FIGS. 3 to 5 is similar to the conductive antenna element 20 illustrated in FIG. 2, and the same reference numerals in FIG. 2 and in FIGS. 3 to 5 denote the same or similar components, having the same or similar function. The conductive antenna element 20 illustrated in each of FIGS. 3 to 5 differs from the conductive antenna element 20 illustrated in FIG. 2 in that the slots 31, 32, 33, 34 of the conductive antenna element 20 illustrated in each of FIGS. 3 to 5 have a different shape compared to the slots 31, 32, 33, 34 of the conductive antenna element 20 illustrated in FIG. 2.

For example, with reference to FIG. 3, each or any of the slots 31, 32, 33, 34 may exhibit a tapered form, wherein the width of the slots 31, 32, 33, 34 increases or decreases in a direction along the length of the respective slot(s). For example, with further reference to FIG. 3, the slots 31, 32, 33, 34 may be relatively wide at the edge or the perimeter 40 of the conductive antenna element 20, and become more narrow as the slots 31, 32, 33, 34 extends on or across the surface 21 on which the slots 31, 32, 33, 34 are arranged, away from the edge or the perimeter 40 (or vice versa). A larger width of the slots 31, 32, 33, 34 may increase a reactance of the conductive antenna element 20, and thereby make it more inductive, while a smaller width of the slots 31, 32, 33, 34 will make the conductive antenna element 20 more capacitive. Possibly, the width of each or any of the slots 31, 32, 33, 34 may vary along at least a portion of the length of the respective ones of the slots 31, 32, 33, 34, or even along the entire length of the respective ones of the slots 31, 32, 33, 34.

For example, with reference to FIGS. 4 and 5, each or any of the slots 31, 32, 33, 34 may have one or more widenings 60, such as a symmetrically shaped widening 60. In the context of the present application, by a slot having a widening it is meant that at least a portion or part of the slot is wider along that portion of the slot than at another portion or part of the slot, e.g., with respect to a longitudinal axis of the slot. As illustrated in FIGS. 4 and 5, each such widening 60 may for example be located along a longitudinal axis of the slot between a distance $R_3$ from the rotational symmetry axis of the conductive antenna element 20 and the distance $R_4$. The conductive antenna element 20 may for example be arranged such that the distance $R_3$ is less than the distance $R_2$, which is the distance from the rotational symmetry axis of the conductive antenna element 20 at which each of the feed points 51, 52, 53, 54 may be located. As further illustrated in FIGS. 4 and 5, the width of the widenings 60 may vary along the longitudinal axis of the associated slot 31, 32, 33, 34, and the width of the widenings 60 along the longitudinal axis of the associated slot 31, 32, 33, 34 may decrease when going in a direction towards the rotational symmetry axis of the conductive antenna element 20. That is, the width of the widenings 60 may be relatively large at the distance $R_3$ from the rotational symmetry axis of the conductive antenna element 20, and may decrease along the longitudinal axis of the associated slot 31, 32, 33, 34 when going in a direction towards the distance $R_4$ from the rotational symmetry axis of the conductive antenna element 20.

While according to the embodiments of the present invention illustrated in FIGS. 2 to 4 the conductive antenna element 20 exhibits a rotational symmetry by virtue of the conductive antenna element 20 being circular, it is to be understood that the conductive antenna element 20 could exhibit a rotational symmetry while having another shape than a circular shape. An example of such other shape is illustrated in FIG. 5.

With further reference to FIGS. 4 and 5, each or any of the slots 31, 32, 33, 34 may have a minimum width $W_{slot}$ (only the width of the slot 34 is indicated in FIGS. 4 and 5). The minimum width of the slot may for example be 0.01 times, or about 0.01 times, of the selected wavelength or the selected center wavelength of the RF signals with which the feed points (not shown in FIGS. 4 and 5; cf. FIG. 2) associated with the slots 31, 32, 33, 34, respectively, may be arranged to be fed.

Figure 6:
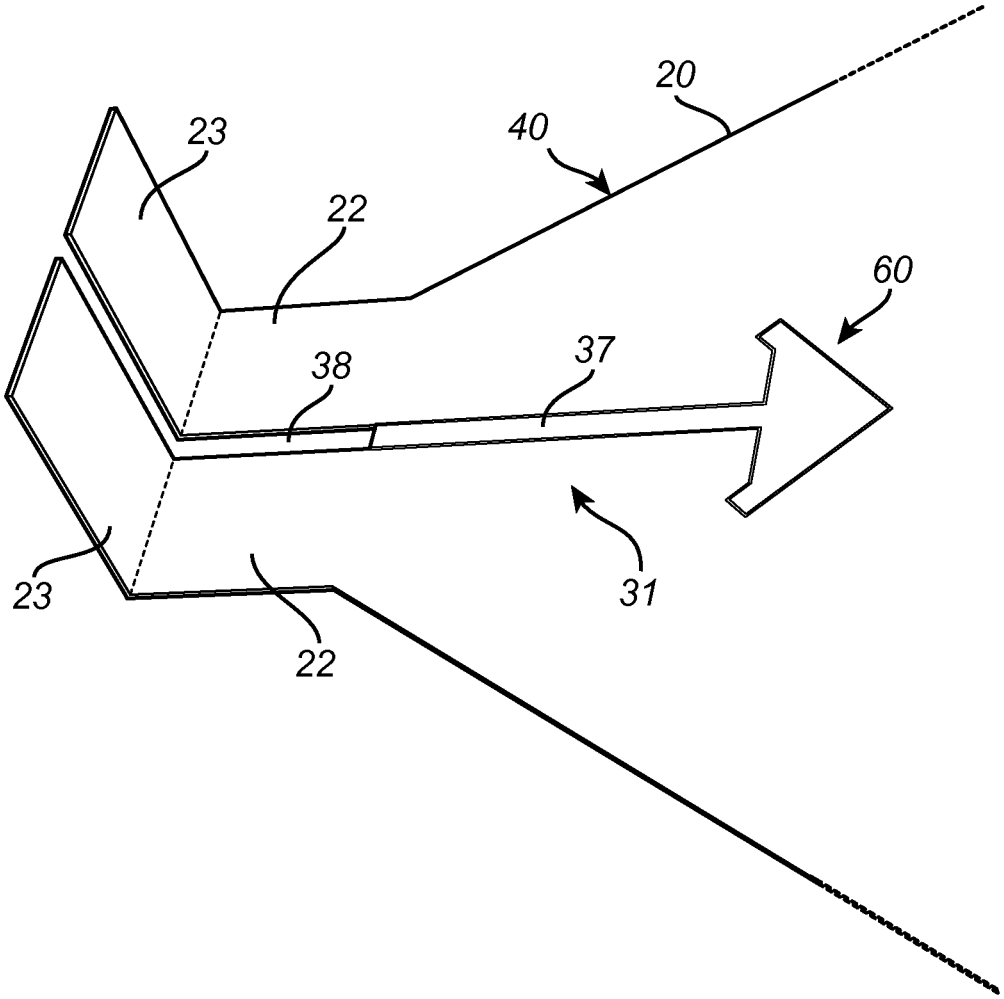
FIG. 6 is a schematic perspective view of a portion of a conductive antenna element in accordance with an embodiment of the present invention.

FIG. 6 is a schematic perspective view of a portion of a conductive antenna element 20 in accordance with an embodiment of the present invention. The portion of the conductive antenna element 20 depicted in FIG. 6 comprises a slot 31 that is similar to the slots 31, 32, 33, 34 comprised in the conductive antenna element 20 illustrated in FIG. 5. Similar to the slots 31, 32, 33, 34 comprised in the conductive antenna element 20 illustrated in FIG. 5, the slot 31 of the portion of the conductive antenna element 20 depicted in FIG. 6 has a widening 60 at one end thereof. Such a widening of the slot 31 is optional.

As illustrated in FIG. 6, the depicted slot 31 is non-planar.

With further reference to FIG. 6, the slot 31 extends on a surface of the conductive antenna element 20 that comprises first planar surface portions, generally indicated at 22, and second planar surface portions, generally indicated at 23. As illustrated in FIG. 6, the first planar surface portions 22 are adjoining, or are contiguous with, the second planar surface portions 23. Further, the first planar surface portions 22 are arranged in relation to the second planar surface portions 23 adjoining the first planar surface portions 22 such that the first planar surface portions 22 are arranged at an angle to the second planar surface portions 23. In accordance with the embodiment of the present invention illustrated in FIG. 6, the angle is 90 degrees, or about 90 degrees, but other values of the angle, smaller or larger than 90 degrees, are possible. As illustrated in FIG. 6, the slot 31 is extending across from the first planar surface portions 22 to the second planar surface portions 23, or vice versa. The first planar surface portions 22 and the second planar surface portions 23 could for example be formed from a bent and/or curved portion of the conductive antenna element 20. The conductive antenna element 20 may for example have been bent along the dotted lines depicted in FIG. 6. In alternative, or in addition, the first planar surface portions 22 and the second planar surface portions 23 could be formed from separate parts which have been joined together (e.g., by means of welding) in such a way that the first planar surface portions 22 are arranged at an angle to the second planar surface portions 23. Other examples are possible. For example, the first planar surface portions 22 and the second planar surface portions 23 could be formed by means of a capacitive coupling of a metal or metallic part (which part may be referred to as a wing), e.g., made of aluminium, to a PCB or another type of substrate (e.g., to the ground plane thereof). The metal or metallic part and the PCB may constitute at least a part or portion of the conductive antenna element 20. As will be described further in the following, the slot 31 comprises a first part 37 and a second part 38. The part 37 of the slot 31 could for example be constituted by an indentation or groove or the like in the PCB, and the part 38 of the slot 31 could be constituted by a slit in the metal or metallic part.

Although FIG. 6 illustrates the case of one slot being non-planar, it is to be understood that each or any of the slot(s) of the conductive antenna element(s) described herein, for example the conductive antenna element(s) illustrated in any of the figures in the accompanying drawings, such as the first conductive antenna element 20 and/or the second conductive antenna element 80, could in alternative be non-planar, even if described and/or depicted herein as being planar. For example, each or any of the slot(s) of the conductive antenna element(s) described herein could be configured similar or identical to the slot 31 arranged in the portion of the conductive antenna element 20 depicted in FIG. 6.

With further reference to FIG. 6, the slot 31 comprises a first part 37 and a second part 38, wherein the first part 37 of the slot 31 is constituted by an indentation or groove or the like in the conductive antenna element 20, and the second part 38 of the slot 31 is constituted in part by an indentation or groove or the like in the conductive antenna element 20 and in part by a slit in the conductive antenna element 20, with the slit being contiguous with the indentation or groove. It is to be understood that the illustrated configuration of the slot 31 is according to an example and that other configurations are possible. For example, the entire slot 31 could be constituted by an indentation or groove or the like in the conductive antenna element 20, or the entire slot 31 could be constituted by a slit in the conductive antenna element 20. Also, each or any of the slot(s) of the conductive antenna element(s) described herein could be configured similar or identical to the slot 31 arranged in the portion of the conductive antenna element 20 depicted in FIG. 6.

FIGS. 7 to 10 are schematic perspective view of arrangements 10 according to different embodiments of the present invention. Each of the arrangements 10 illustrated in FIGS. 7 to 10 comprise a first conductive antenna element 20, comprising at least one first slot arranged in the first conductive antenna element 20, and a second conductive antenna element 80, comprising at least one second slot arranged in the second conductive antenna element 80. At least one second slot arranged in the second conductive antenna element 80 is coupled with at least one first slot arranged in the first conductive antenna element 20 by means of at least one conductor. As illustrated in FIGS. 7 to 10, the first conductive antenna element 20 and the second conductive antenna element 80 may be arranged in spaced relation with respect to each other.

Figure 7:
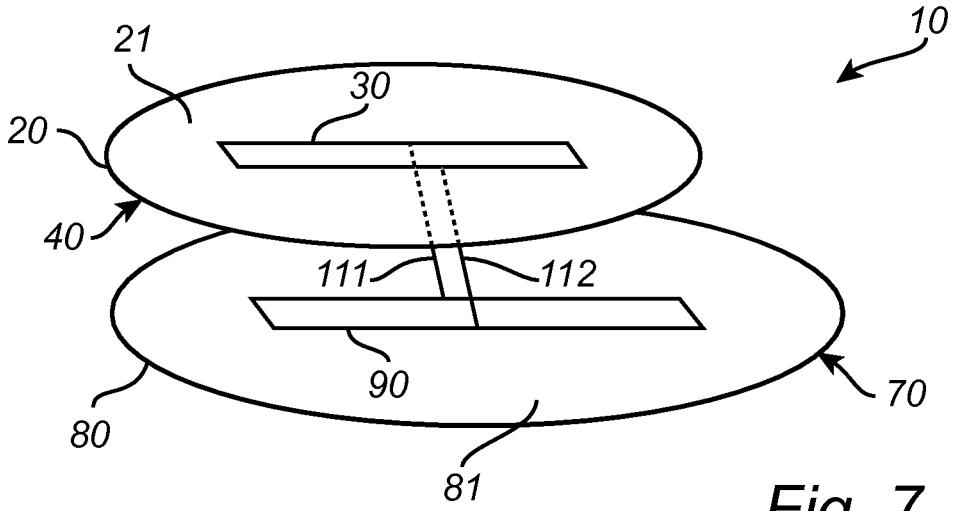
FIGS. 7 to 10 are schematic perspective views of arrangements according to different embodiments of the present invention.

With reference to FIG. 7, each of the first conductive antenna element 20 and the second conductive antenna element 80 comprises one slot, which will be referred to as the first slot 30 and the second slot 90, respectively. As indicated in FIG. 7, the first slot 30 arranged in the first conductive antenna element 20 extends along a first axis (not shown in FIG. 7) and the second slot 90 arranged in the second conductive antenna element 80 extends along a second axis (not shown in FIG. 7). As further indicated in FIG. 7, the first conductive antenna element 20 and the second conductive antenna element 80 are arranged with respect to each other such that the first axis and the second axis are parallel, or substantially parallel. By arranging the first slot 30 and the second slot 90 in the first conductive antenna element 20 and the second conductive antenna element 80, respectively, such that they are extending in a parallel or substantially parallel fashion, the polarizations of the first conductive antenna element 20 and the second conductive antenna element 80 may be the same, or substantially the same.

In accordance with the embodiment of the present invention illustrated in FIG. 7, each of the first conductive antenna element 20 and the second conductive antenna element 80 comprises a plate or a disc, or a plate-like or disc-like element. Other configurations and/or shapes of the first conductive antenna element 20 and/or the second conductive antenna element 80 are however possible. As illustrated in FIG. 7, the first conductive antenna element 20 is arranged above the second conductive antenna element 80, and at a distance from the second conductive antenna element 80.

The first conductive antenna element 20 and the second conductive antenna element 80 comprise surfaces 21 and 81, respectively, on which surfaces 21 and 81 the first slot 30 and the second slot 90, respectively, are arranged. The surfaces 21 and 81 have perimeters 40 and 70, respectively, at least in part defining an edge of the first conductive antenna element 20 and the second conductive antenna element 80, respectively.

The first slot 30 is extending on the surface 21 of the first conductive antenna element 20 within the perimeter 40 but without extending to the edge of the first conductive antenna element 20. Similarly, the second slot 90 is extending on the surface 81 of the second conductive antenna element 80 within the perimeter 70 but without extending to the edge of the second conductive antenna element 80.

As illustrated in FIG. 7, the first slot 30 and the second slot 90 are coupled with each other by means of a pair of conductors 111, 112. To facilitate this, the first slot 30 may be arranged on a side of the first conductive antenna element 20 facing a side of the second conductive antenna element 80 on which the second slot 90 is arranged. However, this is not required. For example, there could be at least one hole or opening (not shown in FIG. 7) in the first conductive antenna element 20 or the second conductive antenna element 80 through which the pair of conductors 111, 112 could extend in order to facilitate coupling of the first slot 30 and the second slot 90 by means of the pair of conductors 111, 112. The same considerations apply to the embodiments of the present invention illustrated in FIGS. 8, 9 and 10.

In accordance with the embodiment of the present invention illustrated in FIG. 7, the pair of conductors 111, 112 are extending between the first slot 30, at a midpoint along the length of the first slot 30, and the second slot 90, at a midpoint along the length of the second slot 90. The midpoints along the lengths of the first slot 30 and the second slot 90, respectively, may not be necessarily be the exact midpoints along the lengths of the first slot 30 and the second slot 90, respectively, but could deviate from the exact midpoints by, e.g., up to 10% of the total length of the first slot 30 or the second slot 90, respectively.

Each or any of the first slot 30 and the second slot 90 may have at least one associated feed point (not shown in FIG. 7; cf. FIG. 2) arranged at the first slot 30 and the second slot 90, respectively, wherein the feed points are arranged to be fed with RF signals having a selected wavelength or a wavelength within a selected wavelength range having a selected center wavelength. Further, each or any of the first slot 30 and the second slot 90 may be associated with one or more feeding termination points, which may be arranged at the respective slot (and located at one of the surfaces 21 and 81), similar as to in the conductive antenna element 20 depicted in FIG. 2, wherein each of the feeding termination points 61, 62, 63, 64 is associated with a slot 31, 32, 33 and 34, respectively. The distance between the first conductive antenna element 20 and the second conductive antenna element 80 may for example be in a range from 0.15 times the selected wavelength or the selected center wavelength to 0.35 times the selected wavelength or the selected center wavelength. The distance between the first conductive antenna element 20 and the second conductive antenna element 80 may be the same, or substantially the same, as the length of the conductors 111, 112 coupling the first slot 30 of the first conductive antenna element 20 and the second slot 90 of the second conductive antenna element 80.

Figure 8:
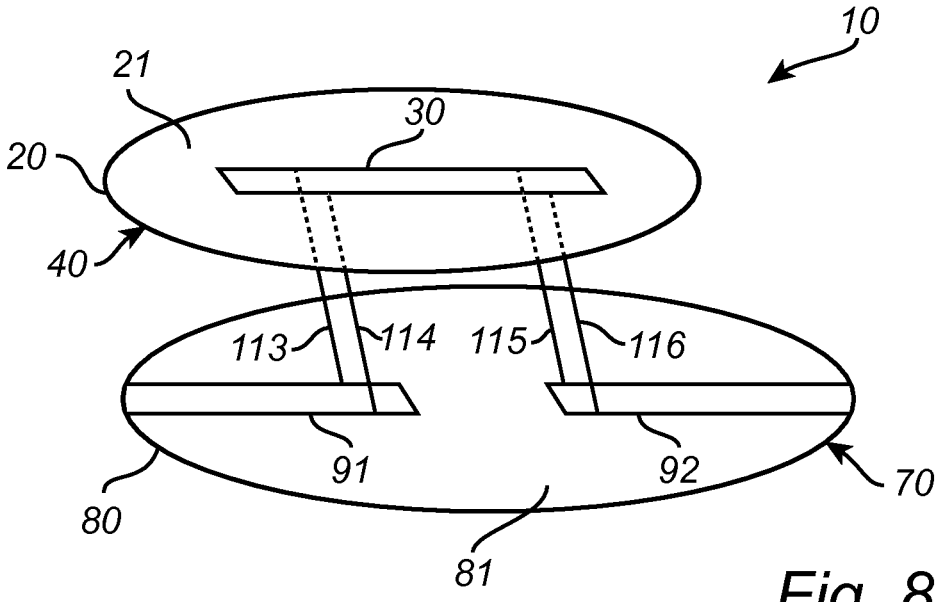

FIG. 8 illustrates an arrangement 10 similar to the arrangement illustrated in FIG. 7, and the same reference numerals in FIGS. 7 and 8 indicate the same or similar components, having the same or similar function. However, while the second conductive antenna element 80 illustrated in FIG. 7 comprises one second slot 90, the second conductive antenna element 80 illustrated in FIG. 8 comprises two second slots 91 and 92. With further reference to FIG. 8, the second slots 91 and 92 are arranged on the surface 81 of the second conductive antenna element 80, and are extending from respective points on the surface 81 within the perimeter 70 of the surface 81 to the edge of the second conductive antenna element 80. As illustrated in FIG. 8, the first slot 30 is coupled with the second slots 91 and 92 by means of two pairs of conductors 113, 114 and 115, 116, respectively. The first slot 30 is coupled with the second slot 91 by means of the pair of conductors 113, 114 between a point along the length of the first slot 30 in the proximity of a first end of the first slot 30 and a point along the length of the second slot 91 in the proximity of an end of the second slot 91 opposite to the end of the second slot 91 that is at the edge of the second conductive antenna element 80. Further, the first slot 30 is coupled with the second slot 92 by means of the pair of conductors 115, 116 between a point along the length of the first slot 30 in the proximity of a second end of the first slot 30, opposite to the first end of the first slot 30, and a point along the length of the second slot 92 in the proximity of an end of the second slot 92 opposite to the end of the second slot 92 that is at the edge of the second conductive antenna element 80.

As indicated in FIG. 8, the first slot 30 arranged in the first conductive antenna element 20 extends along a first axis (not shown in FIG. 8) and each of the second slots 91 and 92 arranged in the second conductive antenna element 80 extends along a respective second axis (not shown in FIG. 8). As indicated in FIG. 8, the second axis of the second slot 91 and the second axis of the second slot 92 are coinciding, or substantially coinciding. As further indicated in FIG. 8, the first conductive antenna element 20 and the second conductive antenna element 80 are arranged with respect to each other such that the first axis is parallel, or substantially parallel, with the second axes of the second slots 91 and 92, respectively. By such arrangement, the polarizations of the first conductive antenna element 20 and the second conductive antenna element 80 may be the same, or substantially the same.

Each or any of the first slot 30 and the second slots 91, 92 may have at least one associated feed point (not shown in FIG. 8; cf. FIG. 2) arranged at the first slot 30 and the second slots 91, 92, respectively, wherein the feed points may be arranged to be fed with RF signals having a selected wavelength or a wavelength within a selected wavelength range having a selected center wavelength. Further, each or any of the first slot 30 and the second slots 91, 92 may be associated with one or more feeding termination points, which may be arranged at the respective slot (and located at one of the surfaces 21 and 81), similar as to in the conductive antenna element 20 depicted in FIG. 2, wherein each of the feeding termination points 61, 62, 63, 64 is associated with a slot 31, 32, 33 and 34, respectively.

As illustrated in FIG. 8, the first conductive antenna element 20 is arranged above the second conductive antenna element 80, and at a distance from the second conductive antenna element 80. The distance between the first conductive antenna element 20 and the second conductive antenna element 80 in the arrangement 10 illustrated in FIG. 8 may be the same, or substantially the same, as the distance between the first conductive antenna element 20 and the second conductive antenna element 80 in the arrangement 10 illustrated in FIG. 7.

Figure 9:
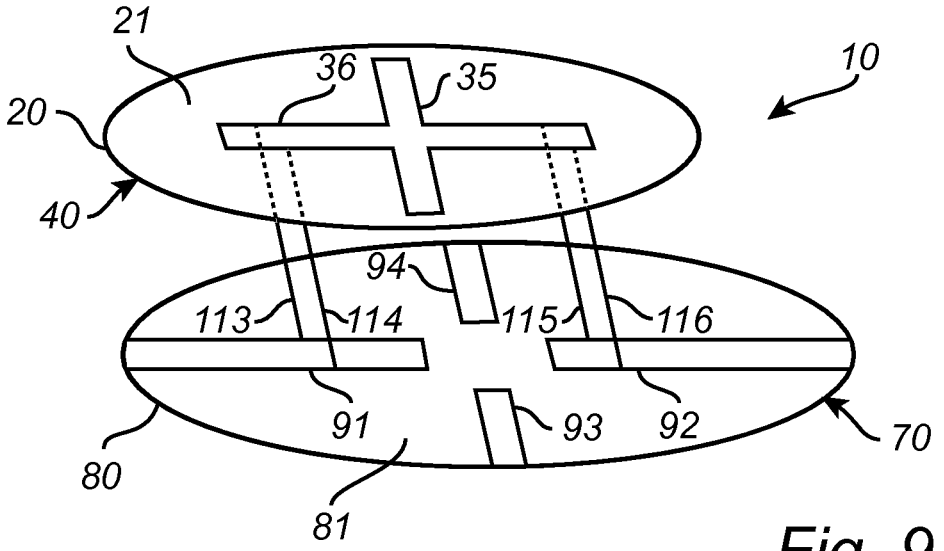

FIG. 9 illustrates an arrangement 10 similar to the arrangements illustrated in FIGS. 7 and 8, and the same reference numerals in FIG. 9 and in FIGS. 7 and 8 indicate the same or similar components, having the same or similar function.

With reference to FIG. 9, the first conductive antenna element 20 comprises two first slots 35, 36 arranged in the first conductive antenna element 20. As illustrated in FIG. 9, the first slots 35, 36 are arranged on the surface 21 and are extending on the surface within the perimeter 40 of the surface 21 but without extending to the edge of the first conductive antenna element 20. In accordance with the embodiment of the present invention illustrated in FIG. 9, the first slots 35, 36 are extending on the surface 21 so as to intersect each other in region on the surface 21 that is approximately at the center of the surface 21. The second conductive antenna element 80 illustrated in FIG. 9 comprises four second slots 91, 92, 93 and 94. The second slots 91, 92, 93 and 92 are arranged on the surface 81 of the second conductive antenna element 80, and are extending from respective points on the surface 81 within the perimeter 70 of the surface 81 to the edge of the second conductive antenna element 80.

As illustrated in FIG. 9, the first slot 36 is coupled with the second slots 91 and 92 by means of two pairs of conductors 113, 114 and 115, 116. The first slot 36 is coupled with the second slot 91 by means of the pair of conductors 113, 114 between a point along the length of the first slot 36 in the proximity of a first end of the first slot 36 and a point along the length of the second slot 91 in the proximity of an end of the second slot 91 opposite to the end of the second slot 91 that is at the edge of the second conductive antenna element 80. Further, the first slot 36 is coupled with the second slot 92 by means of the pair of conductors 115, 116 between a point along the length of the first slot 36 in the proximity of a second end of the first slot 36, opposite to the first end of the first slot 36, and a point along the length of the second slot 92 in the proximity of an end of the second slot 92 opposite to the end of the second slot 92 that is at the edge of the second conductive antenna element 80.

In alternative, or in addition, the first slot 35 could be coupled with the second slots 93 and 94 in the same or similar manner as the first slot 36 is coupled with the second slots 91 and 92 as described in the foregoing.

As indicated in FIG. 9, the first slot 36 arranged in the first conductive antenna element 20 extends along a first axis (not shown in FIG. 9) and each of the second slots 91 and 92 arranged in the second conductive antenna element 80 extends along a respective second axis (not shown in FIG. 9). As indicated in FIG. 9, the second axis of the second slot 91 and the second axis of the second slot 92 are coinciding, or substantially coinciding. As further indicated in FIG. 9, the first conductive antenna element 20 and the second conductive antenna element 80 are arranged with respect to each other such that the first axis is parallel, or substantially parallel, with the second axes of the second slots 91 and 92, respectively. By such arrangement, the polarizations of the first conductive antenna element 20 and the second conductive antenna element 80 may be the same, or substantially the same.

Each or any of the first slots 35, 36 and the second slots 91, 92, 93, 94 may have at least one associated feed point (not shown in FIG. 9; cf. FIG. 2) arranged at the first slots 35, 36 and the second slots 91, 92, 93, 94 respectively, wherein the feed points may be arranged to be fed with RF signals having a selected wavelength or a wavelength within a selected wavelength range having a selected center wavelength. Further, each or any of the first slots 35, 36 and the second slots 91, 92, 93, 94 may be associated with one or more feeding termination points, which may be arranged at the respective slot (and located at one of the surfaces 21 and 81), similar as to in the conductive antenna element 20 depicted in FIG. 2, wherein each of the feeding termination points 61, 62, 63, 64 is associated with a slot 31, 32, 33 and 34, respectively.

As illustrated in FIG. 9, the first conductive antenna element 20 is arranged above the second conductive antenna element 80, and at a distance from the second conductive antenna element 80. The distance between the first conductive antenna element 20 and the second conductive antenna element 80 in the arrangement 10 illustrated in FIG. 9 may be the same, or substantially the same, as the distance between the first conductive antenna element 20 and the second conductive antenna element 80 in the arrangement 10 illustrated in FIG. 7 or 8.

Figure 10:
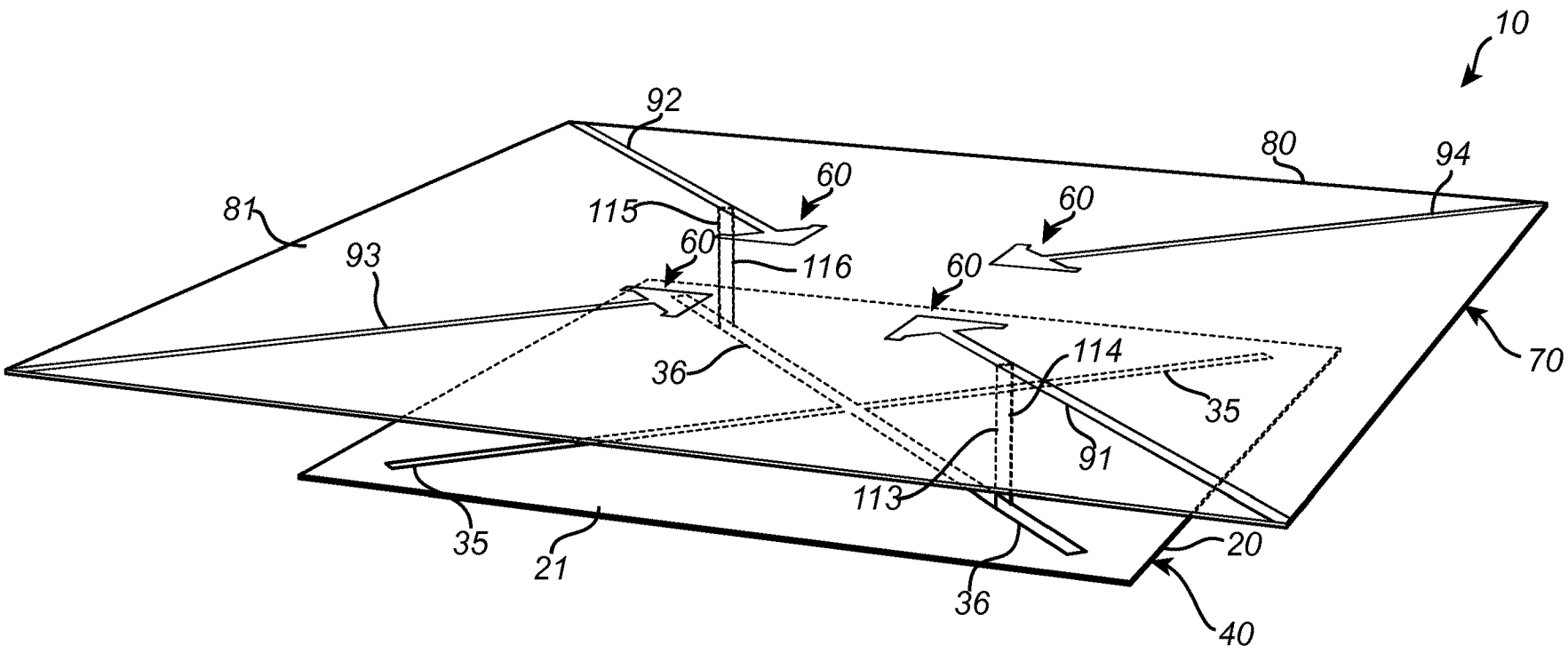

FIG. 10 illustrates an arrangement 10 similar to the arrangements illustrated in FIGS. 7 to 9, and the same reference numerals in FIG. 10 and in FIGS. 7 to 9 indicate the same or similar components, having the same or similar function.

As illustrated in FIG. 10, the first conductive antenna element 20 is arranged below the second conductive antenna element 80, and at a distance from the second conductive antenna element 80. The distance between the first conductive antenna element 20 and the second conductive antenna element 80 in the arrangement 10 illustrated in FIG. 10 may be the same, or substantially the same, as the distance between the first conductive antenna element 20 and the second conductive antenna element 80 in the arrangement 10 illustrated in FIG. 7, 8 or 9.

The first conductive antenna element 20 of the arrangement illustrated in FIG. 10 is similar to the first conductive antenna element 20 of the arrangement illustrated in FIG. 9, and comprises two first slots 35, 36 arranged in the first conductive antenna element 20. As illustrated in FIG. 10, the first slots 35, 36 are arranged on the surface 21 and are extending on the surface within the perimeter 40 of the surface 21 but without extending to the edge of the first conductive antenna element 20. In accordance with the embodiment of the present invention illustrated in FIG. 10, the first slots 35, 36 are extending on the surface 21 so as to intersect each other in region on the surface 21 that is approximately at the center of the surface 21.

The second conductive antenna element 80 of the arrangement illustrated in FIG. 10 is similar to the conductive antenna element 80 of the arrangement illustrated in FIG. 9, and comprises four second slots 91, 92, 93 and 94. The second slots 91, 92, 93 and 94 are arranged on the surface 81 of the second conductive antenna element 80, and are extending from respective points on the surface 81 within the perimeter 70 of the surface 81 to the edge of the second conductive antenna element 80.

In contrast to the second slots 91, 92, 93 and 94 of the second conductive antenna element 80 of the arrangement illustrated in FIG. 9, each of the second slots 91, 92, 93 and 94 of the second conductive antenna element 80 of the arrangement illustrated in FIG. 10 has a symmetrically shaped widening 60 at one end thereof. The widenings 60 are similar to the widenings 60 of the slots 31, 32, 33, 34 of the conductive antenna element 20 illustrated in, and described in the foregoing with reference to, FIG. 5. As per the embodiment of the present invention illustrated in FIG. 10, the widenings 60 of the second slots 91, 92, 93, 94 may be located at the respective ends thereof that are located farthest away from the perimeter 70 (and edge) of the second conductive antenna element 80 compared to the other ends of the second slots 91, 92, 93, 94, respectively.

As illustrated in FIG. 10, the first slot 36 is coupled with the second slots 91 and 92 by means of two pairs of conductors 113, 114 and 115, 116. The first slot 36 is coupled with the second slot 91 by means of the pair of conductors 113, 114 between a point along the length of the first slot 36 in the proximity of a first end of the first slot 36 and a point along the length of the second slot 91 in the proximity of an end of the second slot 91 opposite to the end of the second slot 91 that is at the edge of the second conductive antenna element 80. Further, the first slot 36 is coupled with the second slot 92 by means of the pair of conductors 115, 116 between a point along the length of the first slot 36 in the proximity of a second end of the first slot 36, opposite to the first end of the first slot 36, and a point along the length of the second slot 92 in the proximity of an end of the second slot 92 opposite to the end of the second slot 92 that is at the edge of the second conductive antenna element 80.

In alternative, or in addition, the first slot 35 could be coupled with the second slots 93 and 94 in the same or similar manner as the first slot 36 is coupled with the second slots 91 and 92 as described in the foregoing.

As indicated in FIG. 10, the first slot 36 arranged in the first conductive antenna element 20 extends along a first axis (not shown in FIG. 10) and each of the second slots 91 and 92 is arranged in the second conductive antenna element 80 extends along a respective second axis (not shown in FIG. 10). As indicated in FIG. 10, the second axis of the second slot 91 and the second axis of the second slot 92 are coinciding, or substantially coinciding. As further indicated in FIG. 10, the first conductive antenna element 20 and the second conductive antenna element 80 are arranged with respect to each other such that the first axis is parallel, or substantially parallel, with the second axes of the second slots 91 and 92, respectively. By such arrangement, the polarizations of the first conductive antenna element 20 and the second conductive antenna element 80 may be the same, or substantially the same.

Each or any of the first slots 35, 36 and the second slots 91, 92, 93, 94 may have at least one associated feed point (not shown in FIG. 10; cf. FIG. 2) arranged at the first slots 35, 36 and the second slots 91, 92, 93, 94 respectively, wherein the feed points may be arranged to be fed with RF signals having a selected wavelength or a wavelength within a selected wavelength range having a selected center wavelength. Further, each or any of the first slots 35, 36 and the second slots 91, 92, 93, 94 may be associated with one or more feeding termination points, which may be arranged at the respective slot (and located at one of the surfaces 21 and 81), similar as to in the conductive antenna element 20 depicted in FIG. 2, wherein each of the feeding termination points 61, 62, 63, 64 is associated with a slot 31, 32, 33 and 34, respectively.

It is to be understood that although FIG. 10 illustrates a case wherein the second conductive antenna element 80 is arranged above the first conductive antenna element 20, it may be preferred to arrange the first conductive antenna element 20 above the second conductive antenna element 80, at least when the arrangement 10 is in use. However, the case illustrated in FIG. 10 wherein the second conductive antenna element 80 is arranged above the first conductive antenna element 20 is nevertheless possible.

It is to be understood that even though the first conductive antenna element 20 and the second conductive element 80 of the arrangements illustrated in FIGS. 7 to 10 are planar, and the first slot(s) and the second slot(s) arranged in the first conductive antenna element 20 and the second conductive antenna element 80, respectively, are planar, this is not required. At least a part or portion of the first conductive antenna element 20 and/or the second conductive antenna element 80 may be non-planar. Further, at least one first slot of the first conductive antenna element 20 may be non-planar. Similarly, at least one second slot of the second conductive antenna element 80 may be non-planar.

It is further to be understood that the arrangements illustrated in FIGS. 7 to 10 may include one or more additional elements, which one or more additional elements are not shown in any of FIGS. 7 to 10. Such additional elements may for example comprise a frame or stand on which the first conductive antenna element 20 and the second conductive antenna element 80 are mounted, a support structure for (facilitating) arranging the first conductive antenna element 20 and the second conductive antenna element 80 in a spaced relation, an RF generator or RF source, or a cable or transmission line coupled between the RF generator or RF source and at least one of the first conductive antenna element 20 and the second conductive antenna element 80. The support structure could for example comprise at least one coaxial cable or another or other types of relatively stiff conductors, and/or a stand-off which for example may be made of a plastic material. For example, such a support structure may be extending at least in part along a rotational symmetry axis of the first conductive antenna element 20 and/or the second conductive antenna element 80. Such a support structure may, in alternative or in addition to (facilitating) arranging the first conductive antenna element 20 and the second conductive antenna element 80 (and possibly any additional conductive antenna element) in spaced relation, be used to arrange the first conductive antenna element 20 and/or the second conductive antenna element 80 (or possibly any additional conductive antenna element) in spaced relation to at least one reflector structure. The at least one reflector structure, which may be included in the arrangement, may be referred to as at least one antenna reflector structure, and may be arranged so as to reflect RF waves impinging thereon. The at least one reflector structure may be arranged so as to be located below the first conductive antenna element 20 and/or the second conductive antenna element 80 (or possibly any additional conductive antenna element) when the arrangement is in use. Additional elements such as described in the foregoing, and possibly other additional elements, may be included not only in the arrangements illustrated in FIGS. 7 to 10, but also in arrangements according to any other embodiments of the present invention.

With respect to each of the embodiments of the present invention illustrated in FIGS. 1 to 10 and as described in the foregoing, it is to be understood that the number of slots arranged in the depicted conductive antenna element(s), such as the first conductive antenna element 20 and/or the second conductive antenna element 80, is exemplifying, and that for each of the depicted conductive antenna element(s), the number of slots may be smaller (in case of more than one slot being depicted) or larger than depicted.

In conclusion, an arrangement is disclosed. The arrangement comprises a first antenna element, comprising at least one first slot arranged in the first antenna element, and a second antenna element, comprising at least one second slot arranged in the second antenna element. At least one second slot arranged in the second antenna element is connected or coupled with at least one first slot arranged in the first antenna element, e.g., by means of at least one conductor.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An arrangement comprising:

a first conductive antenna element comprising at least one first slot arranged in the first conductive antenna element; and a second conductive antenna element comprising at least one second slot arranged in the second conductive antenna element;

wherein at least one second slot arranged in the second conductive antenna element is coupled with at least one first slot arranged in the first conductive antenna element by means of at least one conductor;

wherein each of the at least one first slot of the first conductive antenna element has at least one associated feed point arranged at the respective first slot, and each of the at least one second slot of the second conductive antenna element has at least one associated feed point arranged at the respective second slot, wherein the feed points are arranged to be fed with radio frequency signals having a selected wavelength or a wavelength within a selected wavelength range having a selected center wavelength;

wherein the first conductive antenna element is arranged above or below the second conductive antenna element and at a distance from the second conductive antenna element, wherein the distance is in a range from 0.15 times the selected wavelength or the selected center wavelength to 0.35 times the selected wavelength or the selected center wavelength.

2. An arrangement according to claim 1, wherein at least one first slot arranged in the first conductive antenna element extends along a first axis and at least one second slot arranged in the second conductive antenna element extends along a second axis, wherein the first conductive antenna element and the second conductive antenna element are arranged with respect to each other such that the first axis and the second axis are parallel, or substantially parallel.

3. An arrangement according to claim 1, wherein each of the first conductive antenna element and the second conductive antenna element is plate-shaped, or disc-shaped.

4. An arrangement according to claim 1, wherein the at least one first slot of the first conductive antenna element and the at least one second slot of the second conductive antenna element are coupled with each other by means of a conductor having a length in a range from 0.15 times the selected wavelength or the selected center wavelength to 0.35 times the selected wavelength or the selected center wavelength.

5. An arrangement according to claim 1, wherein at least one of the first conductive antenna element and the second conductive antenna element comprises a surface on which the at least one first slot or the at least one second slot, respectively, is arranged, wherein the surface has a perimeter at least in part defining an edge of the first conductive antenna element or the second conductive antenna element, respectively, and wherein the at least one first slot or the at least one second slot, respectively, is extending on the surface within the perimeter but without extending to the edge of the first conductive antenna element or the second conductive antenna element, respectively.

6. An arrangement according to claim 1, wherein at least one of the first conductive antenna element and the second conductive antenna element comprises a surface on which the at least one first slot or the at least one second slot, respectively, is arranged, wherein the surface has a perimeter at least in part defining an edge of the first conductive antenna element or the second conductive antenna element, respectively, and wherein the at least one first slot or the at least one second slot, respectively, is extending from a point on the surface within the perimeter to the edge of the first conductive antenna element or the second conductive antenna element, respectively.

7. An arrangement according to claim 6, wherein the at least one first slot or the at least one second slot, respectively, is non-planar.

8. An arrangement according to claim 6, wherein the surface comprises a first planar surface portion and a second planar surface portion, wherein the first planar surface portion and second planar surface portion are adjoining each other, and wherein the first planar surface portion and the second planar surface portion are arranged in relation to each other such that the first planar surface portion is arranged at an angle to the second planar surface portion, or vice versa, wherein the at least one first slot or the at least one second slot, respectively, is extending across from the first planar surface portion to the second planar surface portion, or vice versa.

9. An arrangement according to claim 1, wherein the first conductive antenna element comprises at least two first slots arranged in the first conductive antenna element and/or the second conductive antenna element comprises at least two second slots arranged in the second conductive antenna element;

wherein at least one of the first conductive antenna element and the second conductive antenna element comprises a surface on which the at least two first slots or the at least two second slots, respectively, are arranged, wherein the surface has a perimeter at least in part defining an edge of the first conductive antenna element or the second conductive antenna element, respectively, and wherein the at least two first slots or the at least two second slots, respectively, are extending on the surface within the perimeter but without extending to the edge of the first conductive antenna element or the second conductive antenna element, respectively; and wherein at least two of the first slots or at least two of the second slots, respectively, are extending on the surface so as to intersect each other at least at one region on the surface.

10. An arrangement according to claim 1, wherein each of the first conductive antenna element and the second conductive antenna element comprises a surface on which the at least one first slot and the at least one second slot, respectively, is arranged, wherein the surface has a perimeter at least in part defining an edge of the first conductive antenna element and the second conductive antenna element, respectively, and wherein the at least one first slot and the at least one second slot, respectively, is extending on the surface of the first conductive antenna element and the second conductive antenna element, respectively, within the respective perimeter but without extending to the edge of the first conductive antenna element and the second conductive antenna element, respectively, wherein the at least one first slot and the at least one second slot are coupled with each other by means of at least one conductor.

11. An arrangement according to claim 10, wherein the at least one first slot and the at least one second slot are coupled with each other by means of at least one conductor extending between the at least one first slot at a midpoint along the length of the at least one first slot and the at least one second slot at a midpoint along the length of the at least one second slot.

12. An arrangement according to claim 1, wherein the first conductive antenna element comprises at least two first slots arranged in the first conductive antenna element, wherein the first conductive antenna element comprises a surface on which the at least two first slots are arranged, wherein the surface has a perimeter at least in part defining an edge of the first conductive antenna element, and wherein the at least two first slots are extending on the surface within the perimeter but without extending to the edge of the first conductive antenna element, and wherein at least two of the first slots are extending on the surface so as to intersect each other at least at one region on the surface; and wherein the second conductive antenna element comprises at least two second slots arranged in the second conductive antenna element, and wherein the second conductive antenna element comprises a surface on which the at least two second slots are arranged, wherein the surface has a perimeter at least in part defining an edge of the second conductive antenna element, and wherein each of the at least two second slots is extending from a point on the surface within the perimeter to the edge of the second conductive antenna element; and wherein at least one of the at least two intersecting first slots is coupled with at least two of the second slots by means of respective ones of at least two conductors.

13. An arrangement according to claim 12, wherein each of the at least two second slots is extending from a center point on the surface to the edge of the second conductive antenna element.

14. An arrangement according to claim 13, wherein the at least two second slots are rotationally symmetrically arranged on the surface of the second conductive antenna element.

15. An arrangement according to claim 1, wherein the at least one second slot arranged in the second conductive antenna element and/or the at least one first slot arranged in the first conductive antenna element comprises at least one indentation or groove.

16. An arrangement according to claim 1, wherein one of the first conductive antenna element and the second conductive antenna element is a parasitic antenna element.

17. An antenna or antenna unit comprising or being constituted by at least one arrangement according to claim 1.

* * * * *